US005207570A

United States Patent [19]

Voorheis

[11] Patent Number: 5,207,570

[45] Date of Patent: May 4, 1993

[54] BLUFF BODY BAND REGISTER AND BLUFF BODY BAND PILOT

[75] Inventor: James T. Voorheis, Essex Fells, N.J.

[73] Assignee: Voorheis Industries, Inc., West Caldwell, N.J.

[21] Appl. No.: 843,993

[22] Filed: Feb. 26, 1992

[51] Int. Cl.[5] ..... F23M 9/00

[52] U.S. Cl. ..... 431/188; 431/182; 431/352; 60/759

[58] Field of Search ..... 431/350, 173, 352, 188, 431/351, 278, 159, 181, 182; 60/757, 758, 759

[56] References Cited

U.S. PATENT DOCUMENTS 2,684,574 7/1954 Marskell et al. ..... 60/759
3,352,106 11/1967 Pianko ..... 60/759
4,297,093 10/1981 Morimoto et al. .
4,526,322 7/1985 Voorheis .
4,629,416 12/1986 Voorheis .
4,927,356 5/1990 Otsuka et al. ..... 431/351

FOREIGN PATENT DOCUMENTS 1179422 10/1964 Fed. Rep. of Germany ..... 60/757

*Primary Examiner*—Larry Jones
*Attorney, Agent, or Firm*—Klauber & Jackson

[57] ABSTRACT

A burner assembly includes a register including an annular wall defining a chamber, the annular wall including a plurality of coaxial annular bands and a plurality of parallel, axially spaced, circumferentially extending slots which separate the bands and through which air is supplied to the chamber, the annular bands forming a plurality of bluff body elements to the air, the annular bands being formed separate and independent of each other; a plurality of spacer washers inserted between adjacent annular bands to define the slots; a plurality of connecting rods extending through openings in the spacing washers for maintaining the spacing washers in a predetermined relationship and for maintaining the spacing washers between the annular bands; an oil and/or gas gun for supplying a combustible material to the chamber; and a gas pilot for igniting a mixture of the combustible material and the air in the chamber.

13 Claims, 5 Drawing Sheets

BLUFF BODY BAND REGISTER AND BLUFF BODY BAND PILOT

BACKGROUND OF THE INVENTION

The present invention relates generally to burner assemblies, and more particularly, is directed to a register and/or gas pilot for a burner assembly.

Burner assemblies in which gas, oil, coal and/or other combustible materials are mixed with air are well known in the art. Such burner assemblies are generally associated with industrial boilers and furnaces, and comprise a structure known as a register which is usually mounted at the base of the furnace or boiler. The register contains appropriate fuel and air inlets, and houses the burner gun that serves to ignite the fuel. Thus, the combustible material, such as oil, coal and/or gas, enters the register through appropriate inlets formed in the register. In order to provide efficient mixing of the air with the fuel, a plurality of entry ports are generally positioned within the annular side wall of the register, so that the air impacts the combustible material at an angle thereto in order to provide enhanced mixing. Additionally, the entry ports within the annular side wall may be inclined so as to provide a tangential spin to the air supplied to the register.

With such conventional arrangements, the problem of adequate mixing of the air with the combustible material still remains. In other words, it is still desirable to obtain more efficient and effective mixing of the air and fuel. In this regard, the particulate combustible material, such as the atomized oil and pulverized coal, is not fully burned.

Related to this problem of inadequate air balance, that is, inadequate mixing of the fuel and air, there is the problem of reducing emissions, such as carbon monoxide (CO), hydrocarbons (HC), and nitrous oxides (hereinafter referred to as NOx) resulting from oxidation of nitrogen in the air. It is therefore desirable to provide a desired temperature in the burner in order to reduce these emissions, for example, to crack the nitrogen and thereby reduce NOx. With conventional arrangements, however, in order to reduce emissions, some of the output flue gas is recirculated with the input air for combustion. This, however, lowers the temperature in the register, and provides a lower oxygen content for burning, thereby decreasing the efficiency of the burner. Even when preheated air is used, full combustion efficiency is not realized.

There are various reasons, in addition to the above, why conventional register/burner assemblies do not fully reduce the particulate fuel to a gaseous state and do not fully reduce emissions. First, the plane of fuel emission is downstream of the entrance of the combustion air. Thus, when the combustion air meets with the fuel, it competes as a heat receiver with the particulate fuel so that complete burning of the particulate to the point of a state change and vaporization, is delayed. Secondly, because the plane of fuel emissions is downstream of the combustion air, much more air, for example, an order of magnitude more air, meets with the fuel than is required for an immediate sub-stoichiometric (shortage of air) combustion stage. Third, with the plane of fuel emissions downstream of the combustion air, the flame mass immediately radiates to the cooler walls of the furnace prematurely terminating the nascent combustion stage. In the case of a predominantly water wall furnace, the flame is actually severely chilled prior to completion of the sub-stoichiometric or nascent stage of combustion. Fourth, divergent flames hasten the chilling of the flame mass due to the flames's close proximity to the water wall.

Fifth, in the case of inside-mix atomizing steam guns for liquid fuels, considerable steam is condensed when meeting the oil within the gun's mixing chamber prior to nozzle emission. The condensate is harmful to the substoichiometric stage combustion process since it serves as an additional heat sink at a critical time and becomes oil coated particulate. When, with its heavier mass, the oil coated particulate approaches the adjacent water wall, the oil coating becomes chilled to soot.

As discussed in U.S. Pat. No. 4,297,093, various methods have been used for suppressing the generation of NOx and other emissions, such as reduction of the flame temperature, reduction of oxygen concentration in the combustion zone and shortening of the stay time of the combustion gas in the combustion zone of high temperature. However, as described therein, the adoption of these techniques also poses various problems concerning stability of the flame, emission of unburnt substances and smoke, the responsive characteristic to the fluctuation of load, thermal efficiency, the cost of modification of the boiler, increase of the fuel consumption, and the like. U.S. Pat. No. 4,297,093 thereby discloses an arrangement for reducing NOx by utilizing a swirler to provide a small scale of turbulence to the combustion air. The swirler is located in the vicinity of the fuel injection port. The use of a swirler, however, reduces the efficiency of the burner and adds another element thereto.

Related to the turbulence discussed above, it is known that the flow velocity of a combustible mixture is reduced when an obstacle is placed in the flow path thereof. Accordingly, the chances for the flame speed to match the flow velocity at some region in the flow field, a requirement of flame stabilization, are improved. If the obstacle is a bluff body, that is, a non-streamlined body, as the fluid is accelerated, a flow velocity is reached where the adverse pressure gradient downstream from the obstacle is strong enough to set up a recirculating vortex system in the wake of the bluff body, as taught by *Combustion Aerodynamics*, J. M. Beer and N. A. Chigier, Halsted Press Division, John Wiley and Sons, Inc., New York, pages 68 and 73.

In order to solve the problems associated with conventional registers, it has been proposed in U.S. Pat. No. 4,629,416, having a common assignee herewith, to use a bluff body register. Such a bluff body register provides an excellent air balance, regardless of the fuel utilized. Further, such a bluff body register provides maximum turbulence for air entering the register with a pressure drop, resulting in enhanced mixing of the air and fuel, while substantially reducing the NOx.

Specifically, such a bluff body register includes an annular wall, with a plurality of bluff body elements circumferentially spaced about the annular wall in a plurality of axially spaced rows for supplying air to the register. A combustible material is supplied to the register, and a bluff body disc is positioned within each bluff body element for enhancing mixing of the combustible material and the air within the register. Thus, as the air enters the chamber of the register through each bluff body element, there is a resultant pressure drop, whereby the air is caused to disperse through the chamber and thereby mix with the gas or oil fuel. Further, the bluff body discs create toroidal eddies that increase the turbulence of the air entering the register by increasing the velocity and pressure drop thereof, so as to provide enhanced mixing of the fuel and air, and thereby a more efficient burner assembly. As a result, there is a reduction of NOx, without the necessity of providing a swirler at the air input. There is also no need to provide a recirculation of flue gases. This is because a greater amount of burning occurs in the register, which results in a desired temperature and thereby results in cracking of the fuel-bound nitrogen in the sub-stoichiometric zone in the register.

With such a bluff body register, the plane of all fuel emissions is upstream of the combustion air. Further, the combustion air is admitted in stages. Thus, the particulate fuel emissions receive combustion air in a series of stages as ideally required, and without chilling. Since all of the sub-stoichiometric combustion takes place within the confines of the air-cooled register, the flame leaving the register and entering the furnace is totally gaseous, that is, there is full conversion to the gaseous state of all free carbon, all forms of hydrocarbons, all free sulfur, sulfur compounds and any other combustibles in the fuel. Further, with sub-stoichiometric combustion being completed in stages without chilling, no hard soot is formed. The low micron size ash is then "dry" and is free to pass through the furnace, convention banks and air heater or economizer without sticking to any surfaces.

Further, the bluff body elements admit combustion air radially and generate extremely high turbulence, without any rotational spin of the flame envelope, thus insuring that the flame leaving the register is non-divergent or coherent. Soft soot is therefore avoided or minimized, with the flame ends not being in close proximity to the water walls.

Still further, the bluff body register of this patent also serves to prevent any surface migration of carbon monoxide or hydrocarbons. More importantly, the solution to the completion of sub-stoichiometric combustion within the confines of the register is also the solution to reducing NOx formation due to fuel-bound nitrogen, and additionally, a reduction of thermally formed NOx. The elimination or substantial reduction of NOx due to fuel-bound nitrogen, is due to sufficient heat generated by the sub-stoichiometric combustion, in combination with a long sub-stoichiometric flame retention time within the register. Thermally formed NOx is minimized due to the extended sub-stoichiometric region and the non-divergent flame with low penetration of the hotter flame core by the combustion air from the last stage of bluff body elements. Thus, the air from the last row of bluff body elements serves the role of excess post-combustion air.

However, it has been found from experience that the construction of such a register is time consuming and costly. Specifically, a plurality of holes must be cut by a flame torch in the annular wall. In large burner assemblies, this could result in hundreds of holes being cut. Then, the holes must be honed, which is a laborious task. Thereafter, each bluff body element is seated within a hole and welded thereto.

In addition to the aforementioned problems with respect to registers, there are additional problems with conventional gas pilots for use therewith. Specifically, because of the structural arrangement of conventional gas pilots, a gas rich mixture is used. This, however, tends to foul the spark plug therein, resulting in more frequent replacement of the spark plug and more down time for the gas pilot.

OBJECTS AND SUMMARY OF THE INVENTION

Accordingly, it is an object of the present invention to provide a burner assembly and/or gas pilot that overcomes the disadvantages in the prior art.

It is another object of the present invention to provide a burner assembly and/or gas pilot which uses the bluff body principle.

It is yet another object of the present invention to provide a bluff body burner assembly that can be constructed in a small portion of the time necessary to construct conventional bluff body burner assemblies and at a greatly reduced cost.

It is another object of the present invention to provide a burner assembly in which there is efficient and effective mixing of the air with the combustible material.

It is still another object of the present invention to provide a burner assembly in which any particulate combustible material is fully burned.

It is yet another object of the present invention to provide a burner assembly in which emissions, such as carbon monoxide (CO), hydrocarbons (HC), and nitrous oxides (NOx) are reduced or eliminated.

It is a further object of the present invention to provide a burner assembly in which the plane of fuel emission is upstream of the entrance of the combustion air.

It is a still further object of the present invention to provide a burner assembly in which the amount of air needed for combustion is reduced in sub-stoichiometric (shortage of air) combustion stages.

It is a yet further object of the present invention to provide a burner assembly in which there is maximum turbulence for air entering the register, and with a pressure drop, resulting in enhanced mixing of the air and fuel.

It is another object of the present invention to provide a burner assembly in which annular bands of the register create eddies that increase the turbulence of the air entering the register by increasing the velocity and pressure drop thereof, thereby providing enhanced mixing of the fuel and air.

It is still another object of the present invention to provide a burner assembly in which the combustion air is admitted in stages.

It is yet another object of the present invention to provide a burner assembly in which the flame leaving the register and entering the furnace is totally gaseous.

It is a further object of the present invention to provide a burner assembly in which there is no rotational spin of the flame envelope, thus insuring that the flame leaving the register is non-divergent or coherent.

It is a still further object of the present invention to provide a burner assembly which also prevents any surface migration of carbon monoxide or hydrocarbons.

It is a yet further object of the present invention to provide completion of sub-stoichiometric combustion within the confines of the register.

It is another object of the present invention to provide a gas pilot that uses a gas lean mixture at a position adjacent the spark plug.

It is still another object of the present invention to provide a gas pilot that reduces fouling of the spark plug.

It is yet another object of the present invention to provide a gas pilot that in which the combustion air enters the gas tube register downstream of the gas fuel entrance, thereby preventing flameout.

It is a further object of the present invention to provide a gas pilot that allows more gas to be handled than could be handled with conventional gas pilots.

In accordance with an aspect of the present invention, a burner assembly comprises a register including an annular wall defining a chamber, the annular wall including a plurality of coaxial annular bands and a plurality of parallel, axially spaced, circumferentially extending slots which separate the bands and through which air is supplied to the chamber, the annular bands forming a plurality of bluff body elements to the air; means for supplying a combustible material to the chamber; and ignition means for igniting a mixture of the combustible material and the air in the chamber.

In accordance with another aspect of the present invention, a gas pilot assembly comprises a register including an annular wall defining a chamber, the annular wall including a plurality of coaxial annular bands and a plurality of parallel, axially spaced, circumferentially extending slots which separate the bands and through which air is supplied to the chamber, the annular bands forming a plurality of bluff body elements to the air; means for supplying a gas to the chamber; and spark plug means for igniting a mixture of the gas and the air in the chamber.

The above and other objects, features and advantages of the present invention will become readily apparent from the following detailed description which is to be read in connection with the accompanying drawings.

DETAILED DESCRIPTION OF THE PREFERRED EMBODIMENTS

Figure 1:
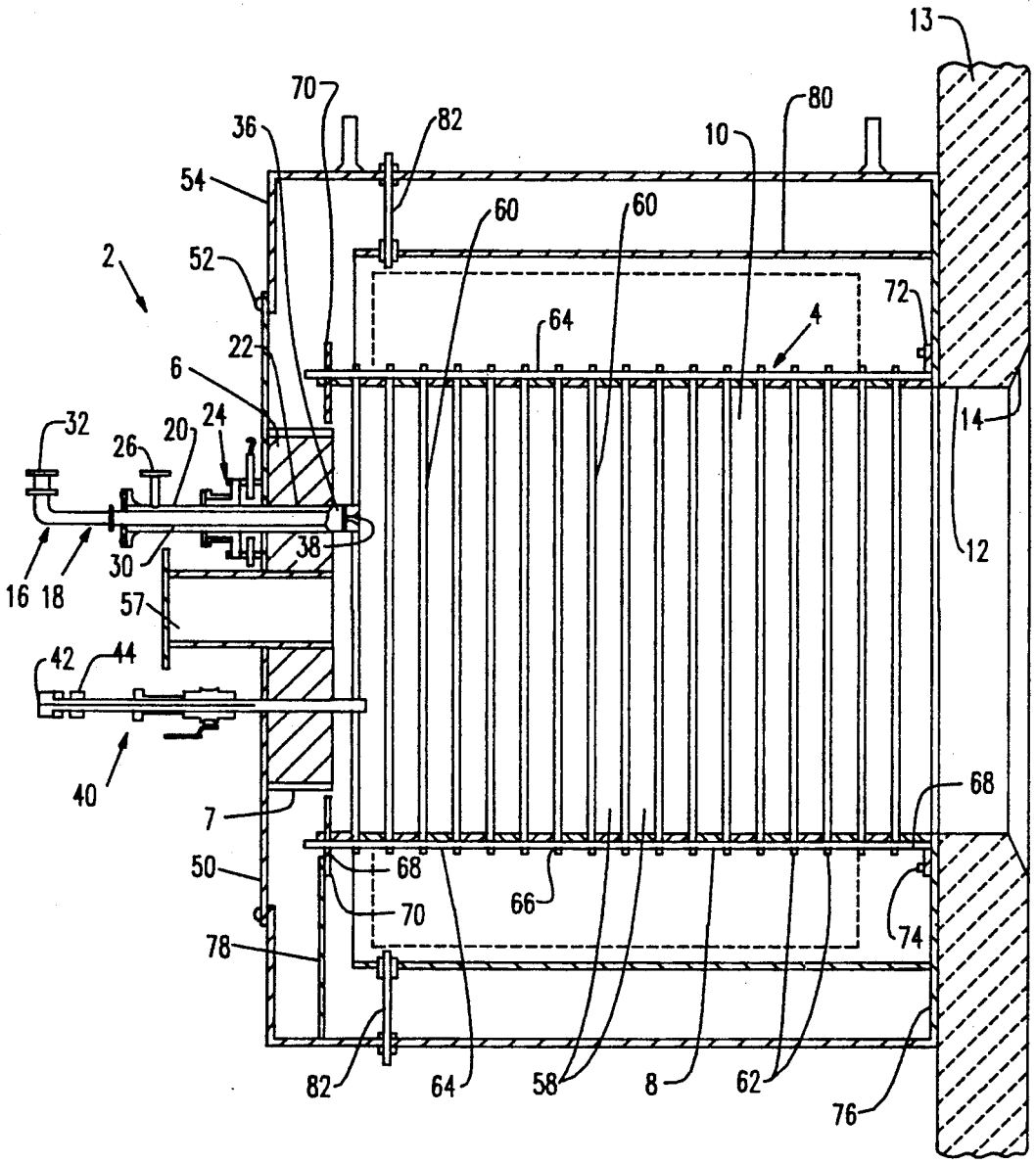
FIG. 1 is a schematic, cross-sectional view of an oil burner assembly according to one embodiment of the present invention, with only one of the oil guns being shown.
Figure 2:
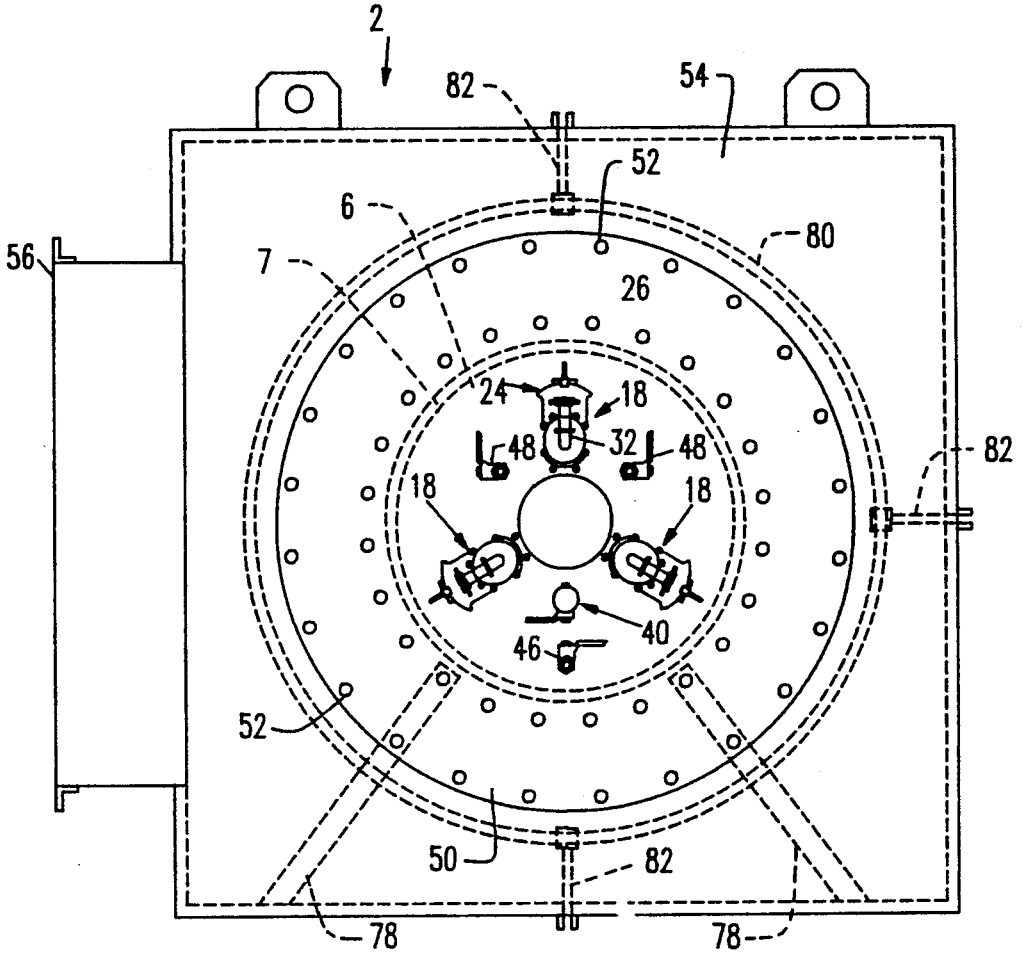
FIG. 2 is a front elevational view of the burner assembly of FIG. 1.

Referring to the drawings in detail, and initially to FIGS. 1 and 2 thereof, a burner assembly 2 according the present invention, which utilizes oil as the fuel component, generally includes a register 4 having a circular front or inlet wall 6 and a side circumferential or annular wall 8, which defines a cylindrical enclosure or chamber 10 within which the air and fuel are mixed. Front wall 6 is also surrounded by an annular plate 7. The outlet end of circumferential wall 8 is open, and is coextensive with an opening 12 in an outlet wall 13. Opening 12 preferably diverges as at 14, at the exit thereof, for example, at a 45° angle.

Means 16 for supplying oil to register 4 extends within front wall 6 thereof. In particular, means 16 includes three equiangularly spaced oil gun assemblies 18 for use when oil is the main fuel. Each oil gun assembly 18 includes a burner pipe 20 extending partly through an aperture 22 within front wall 6 and is held in place thereof by an oil gun mounting bracket 24. Atomizing steam or air is supplied to burner pipe 20 from a socket flange 26 through an atomizing steam box (not shown).

An oil tube 30 is centrally positioned within burner pipe 20 for supplying oil to register 4. More particularly, oil pipe 30 is supplied with oil from an oil inlet pipe 32, as is conventional, with the forward or supply end of oil pipe 30 extending out of register 4. The opposite discharge or free end of oil pipe 30 is secured in a series connection to a spinner assembly 36 and a nozzle 38 extending from burner pipe 20 and through which the atomized oil, for example, of 5 micron size, is discharged within register 4. Such an oil tube 30 can be of the type generally disclosed in U.S. Pat. No. 4,526,322, to the same inventor herein, entitled "Flow-Reversing Nozzle Assembly", the entire disclosure of which is incorporated herein by reference.

In addition, a gas/electric pilot ignitor pipe 40 extends through front wall 6 and includes a pilot gas inlet 42 and an air inlet 44 at the end thereof extending from register 4. Although a conventional gas/electric pilot ignitor pipe can be used with the present invention, it will be appreciated that a more efficient gas/electric pilot ignitor pipe is provided by the present invention, and will be described in more detail below. For the sake of the present discussion, gas/electric pilot ignitor pipe 40 provides a pilot light for igniting the oil/air mixture in register 4.

Various other openings are provided in front wall 6, as shown in FIGS. 1 and 2. For example, a peep sight glass 46 and a plurality of connectors 48 for "Fireye" or other scanners, are provided within front wall 6. It is to be noted that the scanner connectors 48, peep sight glass 46, and pilot gas inlet 42 are shown out of position in FIG. 1 in order to better illustrate these elements. The true positions thereof are shown in FIG. 2. However, the positions thereof may be varied within the scope of the present invention. In like manner, the positions of the various elements in front wall 6 may be interchanged, depending on the particular application.

Front wall 6 is welded to a front plate 50 which, in turn, is secured by bolts 52 to a windbox 54 through which air is supplied to register 4. Air is supplied to windbox 54 through an inlet duct flange 56, as shown in FIG. 2.

In addition, a port 57 is provided in the center of front wall 6 for the inclusion of a center fired gas gun inlet, should it be desired to incorporate the latter into burner assembly 2.

The above-described arrangement is conventional, and is generally taught by the disclosure in commonly assigned U.S. Pat. No. 4,629,416, the entire disclosure of which is incorporated herein by reference.

Figure 3:
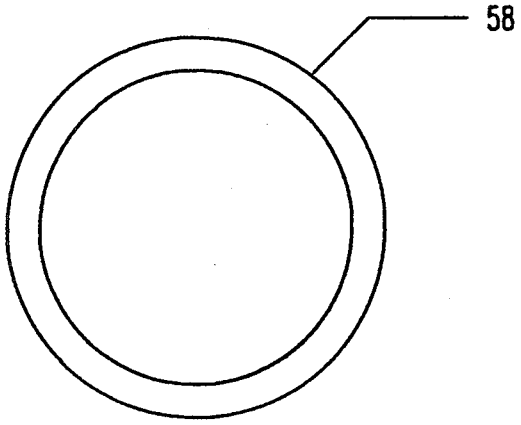
FIG. 3 is a top plan view of a single bluff body band of the burner assembly of FIG. 1.
Figure 4:
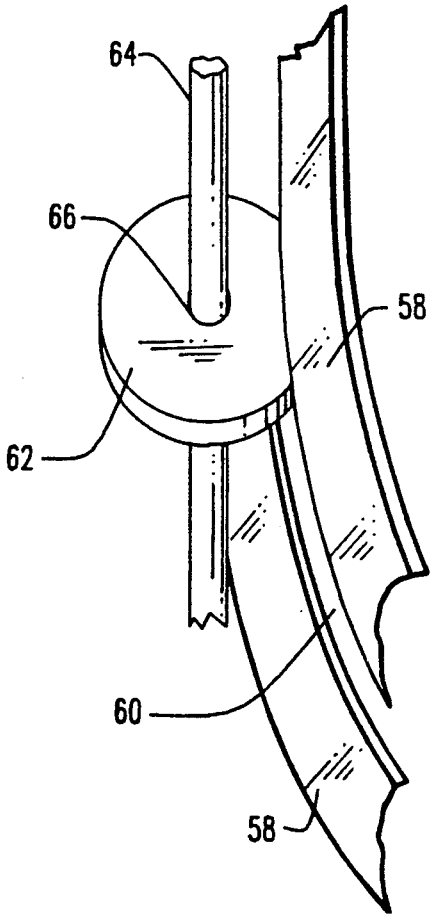
FIG. 4 is a perspective view of a portion of the register of FIG. 1, showing the spacing arrangement for two bluff body bands.

In accordance with an aspect of the present invention, and as shown best in FIGS. 1, 3 and 4, annular wall 8 is formed by a plurality of steel annular bands 58. Although nineteen such bands are shown in FIG. 1, this number will vary depending upon the desired size of register 4. The diameter and thickness of annular bands 58 will also vary in dependence upon the size of burner assembly 2. For example, in the actually constructed embodiment of FIG. 1, each band had an outer diameter of 52 inches, a width of 3 inches and a thickness of ⅜ inch. Annular bands 58 are coaxially arranged with respect to each other, and are assembled together so as to provide a uniform gap or spacing therebetween, hereinafter referred to as slots 60. Slots 60 supply the air from windbox 54 to register 4. It will therefore be appreciated that the width of each slot 60 will vary depending upon the desired air flow. In the actually constructed embodiment of FIG. 1, each slot 60 had a width of 11/32 inch.

In order to assemble annular bands 58 together in such arrangement, a plurality of spacing washers 62 are inserted between adjacent annular bands 58 to define the width of slots 60. In the embodiment of FIGS. 1 and 2, twelve spacing washers 62 are used between each pair of adjacent annular bands 58, with spacing washers 62 being equiangularly arranged in each slot 60. In this manner, the width of slots 60 can be easily changed by using different spacing washers 62 having different thicknesses. Of course, the number of spacing washers 62 will vary in dependence upon the size of burner assembly 2.

The spacing washers 62 in different slots 60 are aligned with each other. Accordingly, a connecting rod 64 can be inserted within the central openings 66 in the aligned spacing washers 62 in order to retain spacing washers 62 in a desired fixed position. The opposite ends of connecting rods 64 are threaded, and end spacing washers 62 are provided on the opposite ends of each connecting rod 64 at the free edges of the first and last annular bands 58. It will be appreciated that the number of connecting rods 64 will preferably be equal to the number of spacing washers 62 per slot 60.

In addition, an inlet annular plate 70 is provided in surrounding relation to front wall 6, and one threaded end of each connecting rod 64 at the inlet or front end of register 4 extends through and is double nut secured thereto. In like manner, an outlet annular plate 72 is provided, and the threaded end of each connecting rod 64 at the outlet end of register 4, is threadedly connected thereto.

Outlet annular plate 72 is secured by bolts 74 to a rear windbox plate 76 that is welded with outlet wall 13. Inlet annular plate 70 is connected with and supported by two register centering fins 78 connected at their opposite ends to windbox 54. Accordingly, annular wall 8 formed by axially spaced annular bands 58, is supported between rear plate 76 and centering fins 78.

Further, a balancing cylinder 80 is connected by three centering stay rods 82 within windbox 54 such that balancing cylinder 80 is in surrounding relation to annular wall 8.

With such arrangement, as the air enters chamber 10 through slots 60, there is a resultant pressure drop, whereby the air is caused to disperse through chamber 10 and thereby mix with the oil fuel. In accordance with an important and essential aspect of the present invention, annular bands 58 function as bluff body barriers to enhance mixture of the fuel and air within register 4. Specifically, annular bands 58 create toroidal eddies that increase the turbulence of the air entering register 4, thereby increasing the velocity and pressure drop thereof, so to provide enhanced mixing of the fuel and air. As a result, there is a reduction of NOx, without the necessity of providing a swirler at the air input. Further, annular bands 58 prevent any carbon monoxide or hydrocarbons from migrating along the wall of register 4, as could occur with the aforementioned U.S. Pat. No. 4,629,416.

In addition, the bands have superior cooling since each band is wiped on both sides and equally thereafter. The superior cooling allows very wide bands for deep registers, without having to use a refractory lining and with little or no NOx. The use of such bands also allows solid fuel to be used without a refractory lining.

More importantly, by using annular bands 58, the same positive effects of the bluff body register of U.S. Pat. No. 4,629,416 are achieved. However, it takes only a few hours to assemble annular wall 8, while it may take tens of hours to construct the register of U.S. Pat. No. 4,629,416.

In the general operation, as the atomized oil enters the inlet end of register 4, it mixes with a small amount of air at the inlet end, that is, with the air entering the first few slots 60. As a result, this mixture is burned in a sub-stoichiometric zone. This is because there is much more fuel than combustion air at this point. As the vaporized oil moves through register 4, it mixes with more air entering through downstream slots 60. Each time that more air is added at each downstream slot 60, the temperature rises. A sufficient temperature is finally reached in register 4 to chemically crack the fuel-bound nitrogen. By the time that the oil has moved adjacent to the next to last slot 60, the oil/air mixture has been completely mixed and gasified. As a result, there is "dry" particulate matter remaining and there are low emissions such as NOx. When it passes the last slot 60, it obtains excess air which is used for the completion of combustion in the furnace.

It will be appreciated that, while annular wall 8 has been discussed with respect to the formation of slots 60 by axially spaced annular bands 58, it is possible to construct annular wall 8 is other ways. For example, it is possible to form annular wall 8 from a continuous cylinder that has the slots cut out therefrom.

Figure 5:
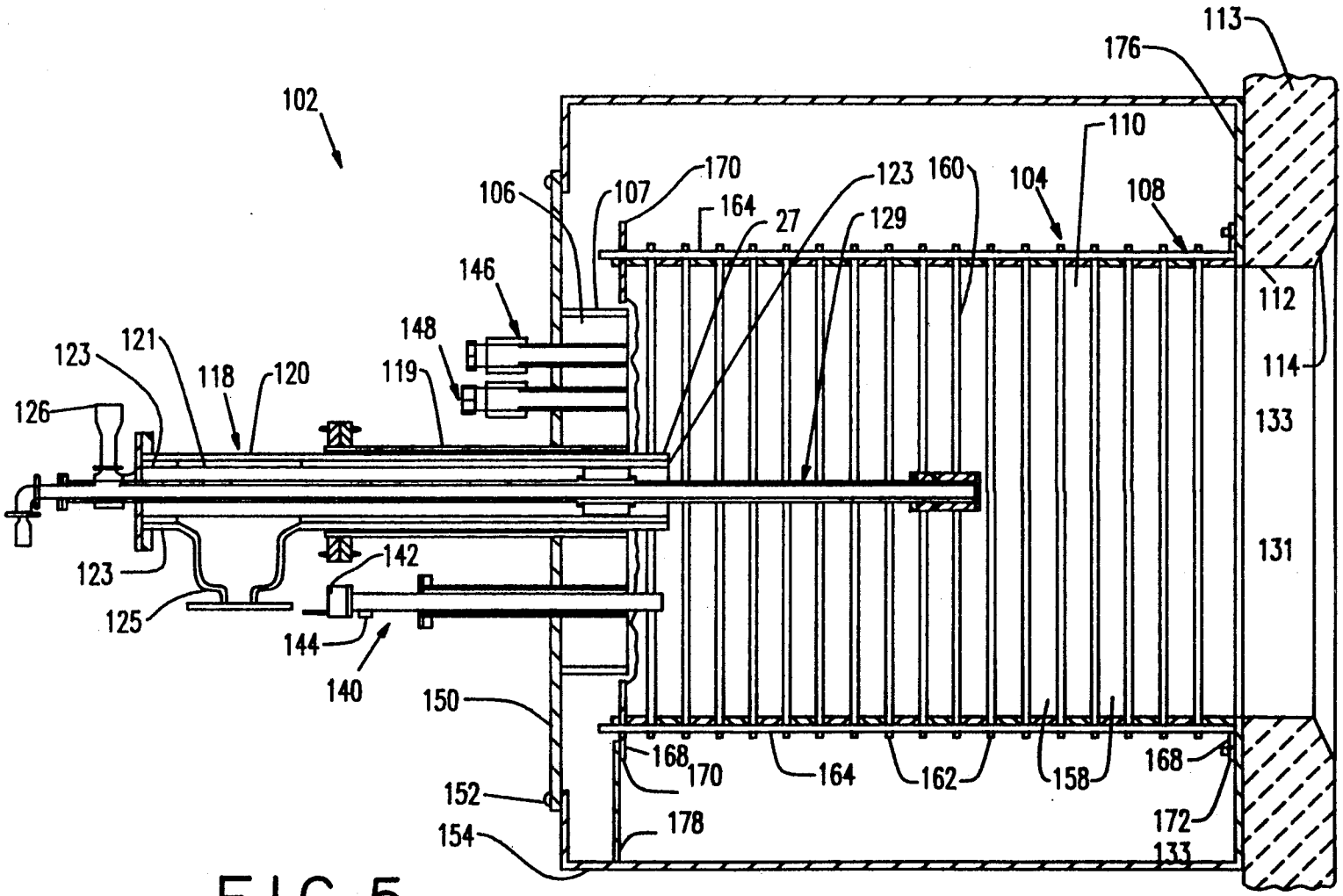
FIG. 5 is a schematic, cross-sectional view of a gas burner assembly according to another embodiment of the present invention.

Referring now to FIG. 5, a burner assembly 102 according to the present invention, which is used with gas as the fuel, will now be described in which elements corresponding to those described above with respect to burner assembly 2 of FIGS. 1–4 are identified by the same reference numerals, augmented by 100, and a detailed description of these common elements will be omitted herein for the sake of brevity.

When burner assembly 102 is not used with an oil fuel, oil gun assembly 118 is used to deliver conditioning/atomizing steam. In some instances, burner assembly 102 can be used with mixed fuels, in which event gun assembly 118 would deliver both steam and oil. Gun assembly 118 includes a supporting pipe 119 for holding gas gun 118 in front wall 106. A gas outer pipe 120 is supported coaxially within supporting pipe 119 by a weld and a gas guide pipe 121 is held coaxially within gas outer pipe 120 by spacers 123 or the like. Gas is supplied through a concentric reducer 125 to the annular space between gas outer pipe 120 and gas guide pipe 121. The end of gas outer pipe 120 extending into chamber 110 is formed with a plurality of rows of gas outlet radial orifices 127 through which the gas enters register 104.

In addition, a ring oil atomizer guide pipe 129 is connected coaxially within gas guide pipe 121 and extends inwardly to approximately the center of register 104, where it is connected with an upstream ring atomizer end assembly 131. The end of ring atomizer guide pipe 129 extending out of register 104 is connected with a steam inlet 126. The steam is carried by ring atomizer guide pipe 129 to upstream ring atomizer end assembly 131 where it exits through an annular port 133 that is rearwardly angled. As a result, the steam is aimed at the first few inlet slots 160. This results in increased turbulence thereat, and thereby aids in the mixing of the incoming air with the gas. It is noted, however, that the steam does not function as an oxidant. As a result, the use of such "conditioning" steam functions in a manner similar to lengthening register 104.

In all other respects, burner assembly 102 is virtually identical with burner assembly 2.

It will be appreciated that the present invention can also be used with other forms of fuel, such a pulverized coal, in a similar manner as taught in U.S. Pat. No. 4,629,416.

Figure 6:
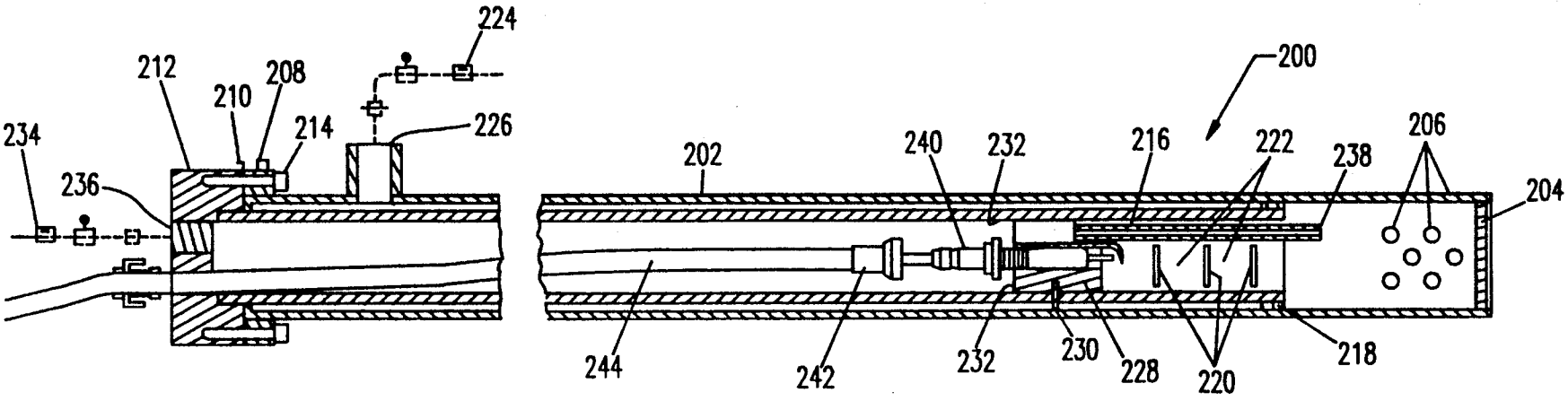
FIG. 6 is a longitudinal cross-sectional view of a bluff body gas pilot that can be used with the burner assemblies according to the present invention.

Referring now to FIG. 6, a bluff body gas pilot 200 according to the present invention will now be described. Bluff body gas pilot 200 can be used in place of gas/electric pilot ignitor pipe 40.

Specifically, bluff body gas pilot 200 includes a combustion air pipe 202 that can extend through front wall 6 of burner assembly 2. The front end of combustion air pipe 202 that extends within register 4 is closed off by an air pipe end plate 204, and four rows of staggered outlet holes 206 are provided in the front end of combustion air pipe 202, as is conventional. The opposite end of combustion air pipe 202 has an air tube flange 208 welded therearound, and the open opposite end of combustion air pipe 202 is closed off by a gasket 210 and a gas tube flange 212, which are secured to air tube flange 208 by bolts 214.

A gas tube register 216 is coaxially mounted within combustion air pipe 202, such that the rear end thereof is connected with gas tube flange 212 and the front end thereof is spaced from combustion air pipe 202 by a closure ring 218. The forward end of gas tube register 216 is formed with parallel, axially spaced arcuate slots 220, which define annular bands 222 therebetween. Accordingly, air which is supplied through a metering valve 224 to an air inlet 226 in combustion air pipe 202, travels in the annular space between combustion air pipe 202 and gas tube register 216. Thereafter, the air enters gas tube register 216 through arcuate slots 220. This arrangement is similar to the arrangement of slots 60 of burner assembly 2.

A gas block 228 partially blocks gas tube register 216 at a position immediately rearwardly of the first slot 220. Gas block 228 is supported in such position by three roll pins 230. A small annular gap 232 is provided between gas block 228 and gas tube register 216. In this manner, gas is supplied through a metering valve 234 to an inlet port 236 of gas tube register 21 6 The gas then travels through gas tube register 216 and through gap 232 into mixing engagement with the air that enters through slots 220. In addition, three raw gas tubes 238 extend through gas block 228 and carry the gas outside of gas tube register 216.

A spark plug 240 is mounted within gas block 228 such that the spark igniting end just extends adjacent the first slot 220 in order to ignite the gas/air mixture in a sub-stoichiometric zone thereat. Spark plug 240 is connected by a spring ignition terminal 242 to a high voltage lead wire 244 that extends out of gas tube flange 212.

Because of the above arrangement, there is a lean supply of gas through small annular gap 232 so that there is a lean gas mixture that is initially burned by spark plug 240. As a result, fouling of spark plug 240 is avoided. The burned mixture picks up more air as it travels out of gas tube register 216 and is then mixed with the raw gas from raw gas tubes 238. The provision of the three raw gas tubes 238 allows much more gas to be handled by pilot 200 than could otherwise be handled in conventional pilots, since the additional gas would provide a mixture which is too gas rich in a conventional pilot.

Further, the combustion air enters the gas tube register downstream of the gas fuel entrance through gap 232, thereby preventing flameout. Thus, the gas/air mixture of pilot 200 is air-rich, and spark plug 240 does not foul. The flame within the register section of pilot 200 thereby acts as a positively anchored pilot to the three raw gas tubes 238.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A burner assembly comprising:

a register including an annular wall defining a chamber, said annular wall including a plurality of coaxial substantially paralled axially spaced annular bands and a plurality of parallel, axially spaced, circumferentially extending slots which separate said bands and through which air is supplied to said chamber, said annular bands forming a plurality of bluff body elements to said air;

means for supplying a combustible material to said chamber; and ignition means for igniting a mixture of said combustible material and said air in said chamber.

2. A burner assembly according to claim 1, wherein said annular bands are formed separate and independent of each other, and are assembled together with said slots therebetween.

3. A burner assembly according to claim 2, further including spacer means for axially spacing said annular bands apart so as to form said slots.

4. A burner assembly according to claim 3, wherein said spacer means includes a plurality of spacing washers inserted between adjacent annular bands, each said spacing washer including an opening, and said spacer means further includes connecting rod means extending through the openings of said spacing washers for maintaining said spacing washers in a predetermined relationship and for maintaining said spacing washers between said annular bands.

5. A burner assembly according to claim 1, wherein said annular wall is a unitary assembly with said slots formed therein so as to define said annular bands, said slots extending for a distance less than the circumference of said annular wall.

6. A burner assembly according to claim 1, wherein said register means includes a front wall, and said means for supplying a combustible material includes oil gun means extending through said front wall of said register means for supplying said oil as said combustible material to said chamber.

7. A burner assembly according to claim 1, wherein said register means includes a front wall, and said means for supplying a combustible material includes gas gun means extending through said front wall of said register means for supplying gas as said combustible material to said chamber.

8. A burner assembly according to claim 1, wherein said register is in communication with a windbox which supplies said air to said chamber through said slots.

9. A gas pilot assembly comprising:

a register including an annular wall defining a chamber, said annular wall including a plurality of coaxial substantially paralled axially spaced annular bands and a plurality of parallel, axially spaced, circumferentially extending slots which separate said bands and through which air is supplied to said chamber, said annular bands forming a plurality of bluff body elements to said air;

means for supplying a gas to said chamber; and spark plug means for igniting a mixture of said gas and said air in said chamber.

10. A gas pilot assembly according to claim 9, wherein said annular wall is a unitary assembly with said slots formed therein so as to define said annular bands, said slots extending for a distance less than the circumference of said annular wall.

11. A gas pilot assembly according to claim 10, wherein said restriction means includes means defining a small annular gap through which said gas is supplied for mixing with said air.

12. A gas pilot assembly according to claim 9, further including restriction means for restricting the amount of gas supplied to said register.

13. A gas pilot assembly according to claim 9, further including raw gas tube means for supplying said gas to a position downstream of said chamber.

* * * * *